US011760544B2

(12) United States Patent
McNamara et al.

(10) Patent No.: US 11,760,544 B2
(45) Date of Patent: Sep. 19, 2023

(54) CLOSEABLE TUMBLER LID

(71) Applicant: Helen of Troy Limited, St. Michael (BB)

(72) Inventors: Conor McNamara, Montclair, NJ (US); Fenton Lane Stith, Bend, OR (US); James David Sareault, Bend, OR (US); Conan Zhang, Bend, OR (US)

(73) Assignee: Helen of Troy Limited, St. Michael (BB)

( * ) Notice: Subject to any disclaimer, the term of this patent is extended or adjusted under 35 U.S.C. 154(b) by 9 days.

(21) Appl. No.: 17/070,126

(22) Filed: Oct. 14, 2020

(65) Prior Publication Data

US 2022/0112011 A1 Apr. 14, 2022

(51) Int. Cl.
*B65D 51/18* (2006.01)
*B65D 43/02* (2006.01)

(52) U.S. Cl.
CPC ..... *B65D 51/18* (2013.01); *B65D 43/021* (2013.01); *B65D 2543/00046* (2013.01);
(Continued)

(58) Field of Classification Search
CPC ..... B65D 51/18; B65D 43/021; B65D 2543/00092; B65D 2543/00046; B65D 2543/0049; B65D 2543/00972; B65D 47/286; B65D 47/30; B65D 47/32; B65D 47/2093; B65D 47/28; B65D 47/241; B65D 2251/0081; B65D 43/0229; B65D 2543/00231; B65D 43/12; B65D 2543/00314; B65D 2543/0074; B65D 43/20; B65D 51/1672; B65D 2543/00194; B65D 2543/00629; B65D 2543/00805;
(Continued)

(56) References Cited

U.S. PATENT DOCUMENTS 4,819,829 A * 4/1989 Rosten ..... B65D 5/727 220/345.3
7,611,029 B2 11/2009 Wong
9,238,529 B1 1/2016 Newman et al.
9,351,597 B2 5/2016 Liu et al.
(Continued)

FOREIGN PATENT DOCUMENTS

WO WO-2007010417 A2 * 1/2007 ..... B65D 83/04
WO WO-2021081197 A1 * 4/2021 ..... A47G 19/2272

*Primary Examiner* — Jennifer Robertson
*Assistant Examiner* — John Martin Hoppmann
(74) *Attorney, Agent, or Firm* — RANKIN, HILL & CLARK LLP

(57) ABSTRACT

A lid assembly for an associated beverage container includes a lid including a lid body having a sidewall for engaging an opening of the associated container and a top wall. The top wall includes an elongated recessed portion formed therein, and a drink opening is located in the recessed portion adjacent the sidewall. A slider is removably received in the recessed portion. The slider is movable along a length direction of the recessed portion between a closed position for closing the drink opening and an open position for opening the drink opening. The lid and the slider have a cooperating detent arrangement configured to maintain the slider in the closed position or the open position, and the slider is configured to compress via the detent arrangement as the slider is moved between the closed position and the open position.

14 Claims, 7 Drawing Sheets

(52) U.S. Cl.
CPC ..... *B65D 2543/0049* (2013.01); *B65D 2543/00092* (2013.01); *B65D 2543/00972* (2013.01)

(58) Field of Classification Search
CPC ..... B65D 47/248; B65D 43/0233; B65D 43/065; B65D 47/14; B65D 47/265; B65D 51/16; B65D 2543/0025; B65D 43/24; A47G 21/08; A47G 19/2272; A47G 19/2288; A47G 19/2266; B29C 45/1671; A24F 23/00; A24F 23/04
USPC ..... 220/354.9, 714, 780, 713, 345.3, 796, 220/254.9, 715, 254.1, 345.6
See application file for complete search history.

(56) References Cited

U.S. PATENT DOCUMENTS

| | | | | |
|---|---|---|---|---|
| 9,938,042 | B1 * | 4/2018 | Aryanpanah | B65D 50/04 |
| 10,124,942 | B2 | 11/2018 | Seiders et al. | |
| 10,232,992 | B2 | 3/2019 | Seiders et al. | |
| 10,232,993 | B2 * | 3/2019 | Seiders | B65D 51/18 |
| 10,306,921 | B2 | 6/2019 | Hermans | |
| 2015/0250341 | A1 * | 9/2015 | Liu | B65D 47/32 220/254.1 |
| 2015/0329250 | A1 * | 11/2015 | Barreto | B65D 47/32 220/351 |
| 2016/0270572 | A1 * | 9/2016 | Karussi | A47G 19/2272 |
| 2017/0066573 | A1 * | 3/2017 | Karussi | B65D 81/3869 |
| 2018/0014671 | A1 | 1/2018 | Karussi et al. | |
| 2018/0289185 | A1 | 10/2018 | Oakes | |
| 2020/0391910 | A1 * | 12/2020 | Pinelli | B65D 47/286 |

* cited by examiner

CLOSEABLE TUMBLER LID

BACKGROUND

Beverage containers can be filled with hot or cold drinkable liquids, such as water, coffee, tea, soft drink, or alcoholic beverage, such as beer. Closures or lids help maintain the temperature of the liquid or beverage within the container and also reduce the likelihood of spills of the beverage from the container during use. Many such container lids include a drinking aperture or opening that can be selectively opened and closed. For example, the drink opening can be opened and closed by moving a slider with respect to a lid body that is attached to the container. Improvements can be made to container lids to aid in further maintaining the temperature of the beverage within the container, and to aid with the cleanability of the lid.

BRIEF DESCRIPTION

According to one aspect, a lid assembly for an associated beverage container comprises a lid including a lid body having a sidewall for engaging an opening of the associated container and a top wall. The top wall includes an elongated recessed portion formed therein, and a drink opening is located in the recessed portion adjacent the sidewall. A slider is removably received in the recessed portion. The slider is movable along a length direction of the recessed portion between a closed position for closing the drink opening and an open position for opening the drink opening. The lid and the slider have a cooperating detent arrangement configured to maintain the slider in the closed position or the open position, and the slider is configured to compress via the detent arrangement as the slider is moved between the closed position and the open position.

According to another aspect, a lid assembly for an associated beverage container comprises a lid including a lid body having a sidewall for engaging an opening of the associated container and a top wall. The top wall includes an elongated recessed portion formed therein. A drink opening and a vent opening are located in the recessed portion. A slider is removably received in the recessed portion. The slider is movable along a length direction of the recessed portion between a closed position where the drink opening and vent opening are closed and an open position where the drink opening and vent opening are open. The slider includes a frame U-shaped in a top plan view and an elastomeric insert secured by the frame. The frame is extended along opposed sides and bottom side edge portions of the insert. The frame is configured to allow for compression of the insert as the slider is moved between the closed position and the open position. The frame is also configured to allow for bowing of the insert as the slider is removed from the recessed portion.

DETAILED DESCRIPTION

Figure 1:
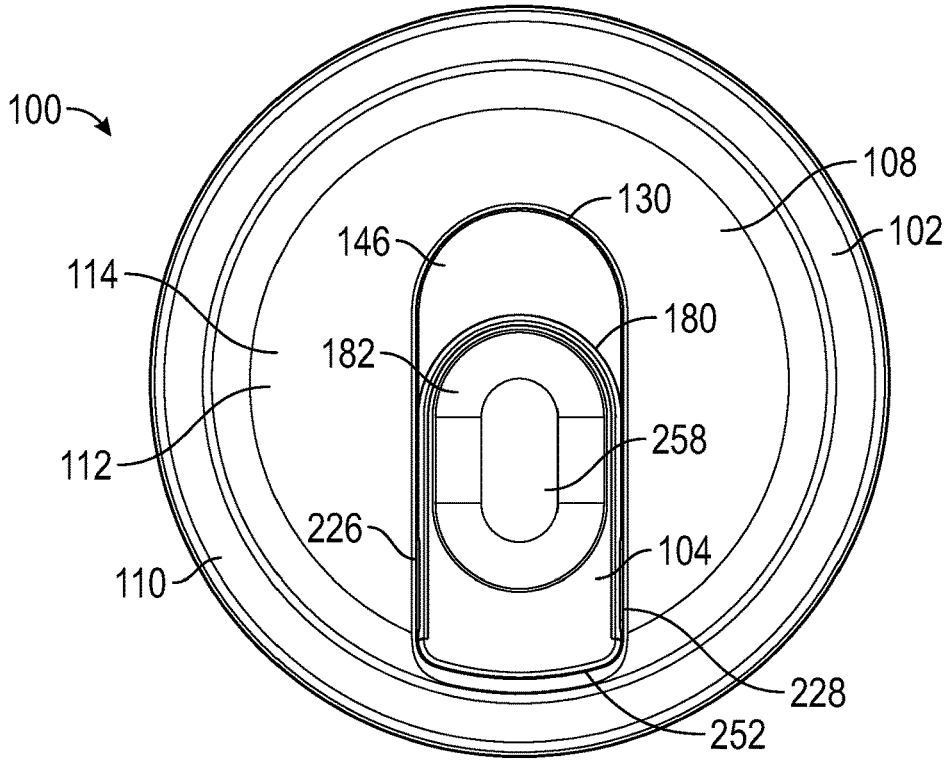
FIG. 1 is a top plan view of a lid assembly according to the present disclosure, the lid assembly including a lid body and a slider, the slider in a closed position.

It should, of course, be understood that the description and drawings herein are merely illustrative and that various modifications and changes can be made in the structures disclosed without departing from the present disclosure. For purposes of description herein, spatially relative terms, such as "upper" and "lower" and the like, may be used to describe an element and/or feature's relationship to another element(s) and/or feature(s) as, for example, illustrated in the figures of the present disclosure.

Referring now to the drawings, wherein like numerals refer to like parts throughout the several views, FIGS. 1-11 illustrate an exemplary lid assembly 100 for use with an associated liquid or beverage container (not shown) according to the present disclosure. It should be appreciated that the associated container can be any known container configured to retain a desired liquid or beverage at a temperature that is either higher or lower than an ambient temperature. For example, the container can be a beverage container, and may correspond to or resemble a bottle, jug, growler, vessel, carafe, or similar beverage container. The container may be fashioned from any material having the desired properties for a beverage container, such as a stainless steel or a plastic formulation (e.g., a thermoplastic, or a thermosetting polymer). In addition, the container may incorporate a double-walled construction, with the intervening space between the walls being substantially evacuated, so that the container is a vacuum-insulated container. Examples of appropriate containers for use with the exemplary lid assembly 100 are those commercially available from HYDRO FLASK (Bend, Oreg.).

Figure 7:
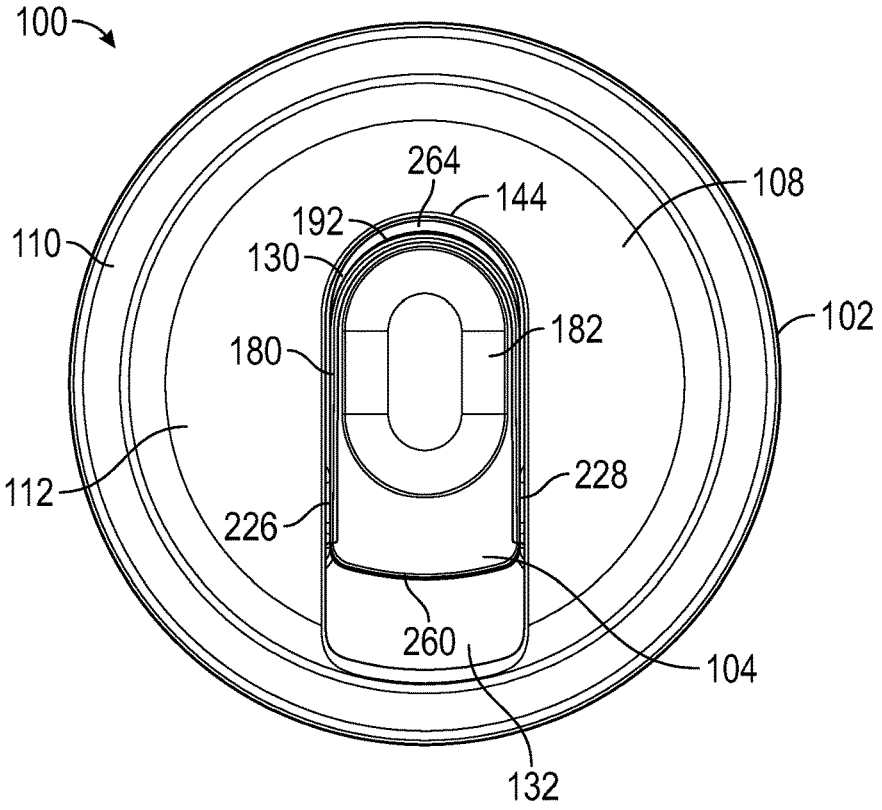
FIG. 7 is a top plan view of the lid assembly according to another aspect of the present disclosure with the slider in an open position.
Figure 8:
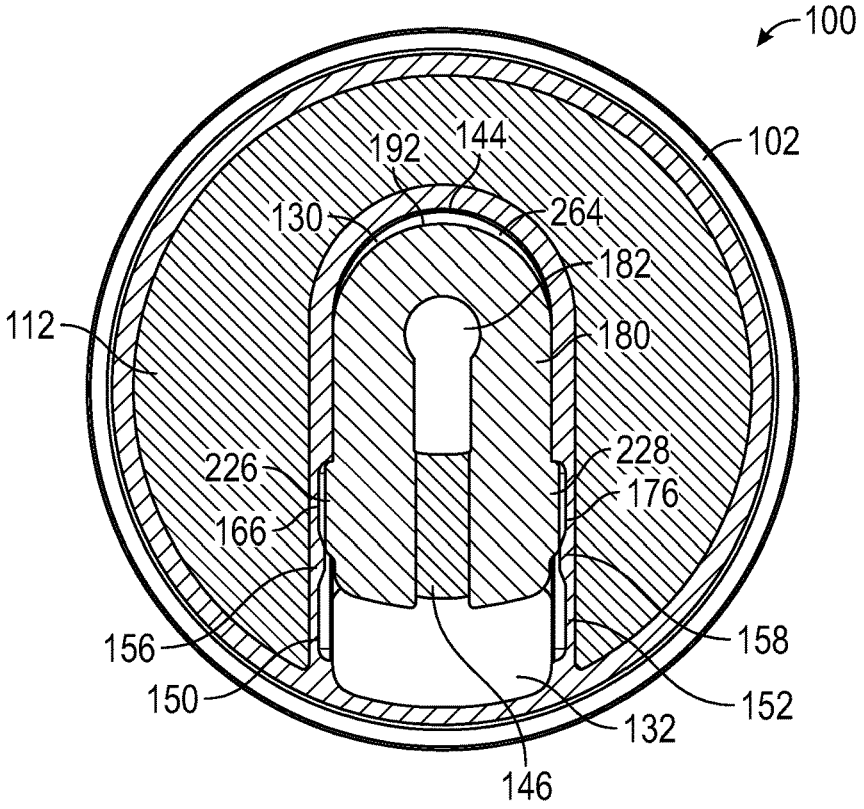
FIG. 8 is a cross-sectional view of the lid assembly of FIG. 7.

With reference to FIGS. 1-4, the lid assembly 100 according to the present disclosure generally comprises a lid 102 and a slider 104 movably coupled to the lid. The lid 102 includes a lid body 108 having a sidewall 110 and a top wall 112 intersecting the sidewall 110 such that the top wall 112 is offset from an upper peripheral edge portion of the sidewall 110. This defines a basin portion 114 of the lid body 108, which can prevent liquid within the container from accidently spilling over the lid 102. The sidewall 110 is formed with a circumferential groove 118 sized to receive a seal member 120 (FIGS. 7 and 8). As is known, with the lid body 108 fitted within an opening of the container (not shown) the seal member 120 sealingly engages an inner surface of the container. The top wall 112 includes an elongated recessed portion 130 formed therein, and a drink opening 132 is located in the recessed portion adjacent the sidewall 110. The slider 104 is sized to be removably received in the recessed portion 130, and is movable along a length direction of the recessed portion 130 between a closed position (FIG. 1) for closing the drink opening 132 and an open position (FIG. 2) for opening the drink opening 132. As will be described below, the lid 102 and the slider 104 have a cooperating detent arrangement configured to maintain the slider 104 in the closed position or the open position.

Figure 2:
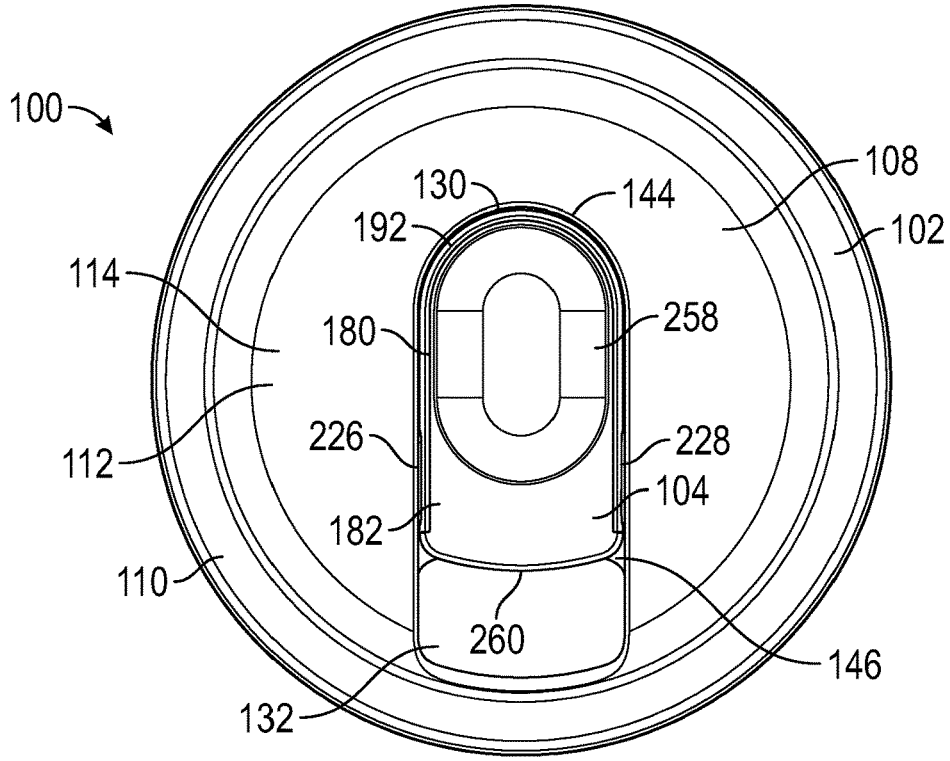
FIG. 2 is a top plan view of the lid assembly of FIG. 1 with the slider in an open position.
Figure 3:
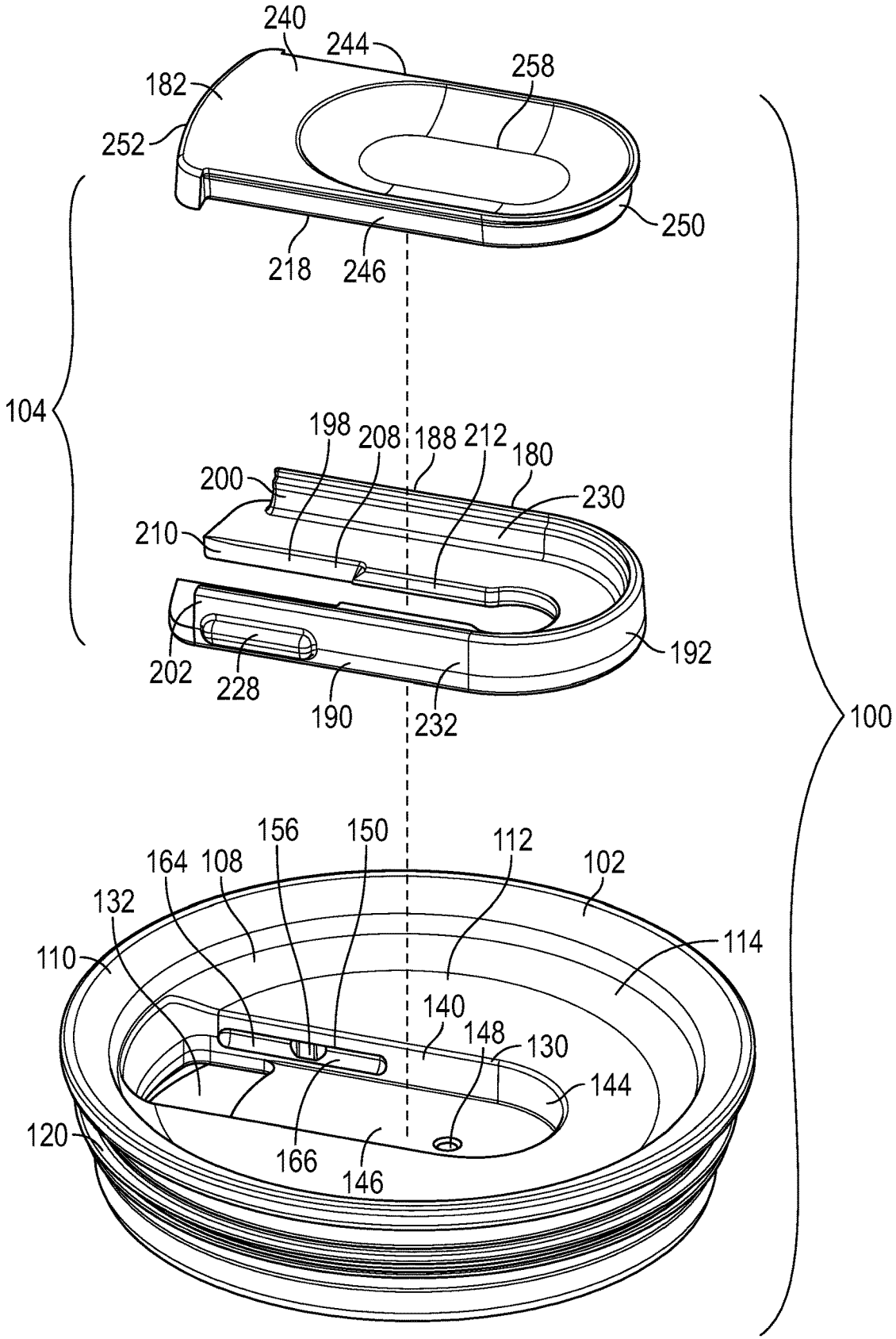
FIGS. 3 and 4 are exploded perspective views of the lid assembly of FIG. 1.
Figure 4:
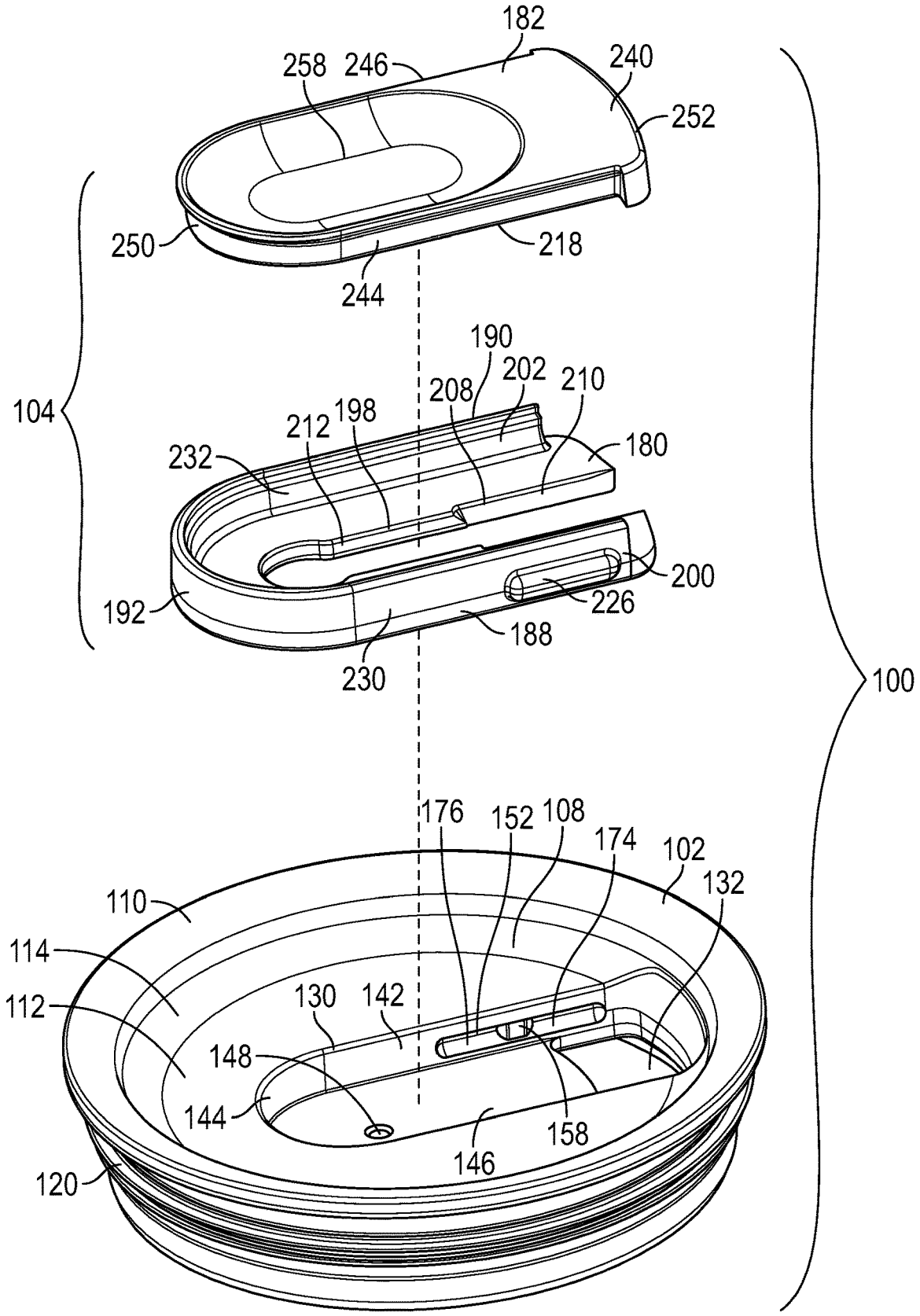

With reference to FIGS. 3 and 4, the recessed portion 130 is defined by inner sidewall sections 140, 142, an inner end section 144, and a base section 146 of the top wall 112. The inner sidewall sections 140, 142 taken together with the inner end section 144 form the recessed portion 130 with a U-shape in top plan view of the lid 102. The drink opening 132 is defined by the sidewall 110, the inner sidewall sections 140, 142 and the base section 146. As shown, the drink opening 132 spans substantially the entire width of the recessed portion 130. A vent opening 148 extends through the base section 146, and in FIGS. 1 and 2 is covered by the slider 104 in both the closed position and open position. According to one aspect, each of the inner sidewall sections 140, 142 includes a respective guide track or channel 150, 152 formed therein, the guide tracks guiding the movement of the slider 104 between the closed position and open position. As depicted, each guide track 150, 152 is sized to be extended partially along a length of the inner sidewall sections 140, 142 and over the drink opening 132. A first detent 156, 158 of the detent arrangement is provided in each respective guide track 150, 152. The first detent 156 separates the guide track 150 into first and second (i.e., forward and rear) guide track sections 164, 166, which can be equally sized in length. Similarly, the first detent 158 separates the guide track 152 into first and second (i.e., forward and rear) guide track sections 174, 176, which can also be equally sized in length.

Figure 6:
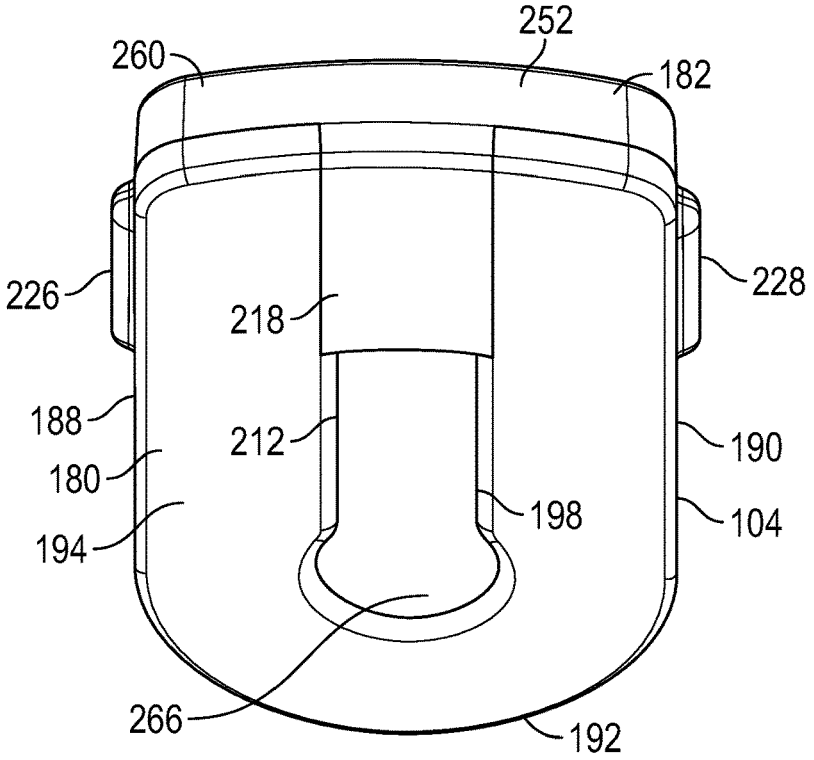
FIG. 6 is a bottom perspective view of the slider.

The slider 104 includes a frame 180 and an insert 182 secured by the frame. The frame 180 includes opposed sides 188, 190, an end wall 192, and a bottom or base 194, and in top plan view an outer periphery of the frame defined by the sides and end wall is U-shaped matching the shape of the recessed portion 130. The base 194 includes an elongated open-ended slot 198, and the slot 198 allows first end portions 200, 202 of the respective sides 188, 190 to flex or move inwardly toward one another. As shown in FIGS. 3 and 4, an inner surface 208 of the base 194 defining the slot 198 includes opposed planar first sections 210 and opposed chamfered second sections 212, allowing for a step-shaped bottom surface 218 of the insert 182 (FIG. 6). Further, each of the sides 188, 190 includes a respective second detent 226, 228 of the detent arrangement. Specifically, the frame sides 188, 190 include the first end portions 200, 202 and an opposite second end portions 230, 232, the second end portions are connected to one another by the end wall 192 to define the U-shape, and the second detents 226, 228 are provided at the first end portions 200, 202. The second detents 226, 228 are sized for slidable receipt within the respective guide tracks 150, 152 as the slider 104 is moved between the closed position and open position. It should be appreciated that the second detents 226, 228 can be sized to be securely received in the first guide track sections 164, 174 in the closed position of the slider 104, and securely received in the second guide track sections 166, 176 in the open position of the slider 104. Therefore, according to one aspect, a length of each second detent can be slightly smaller than a length of each guide track section such that the slider 104 will not move along the guide tracks 150, 152 without an external force applied to the slider by the consumer.

Figure 5:
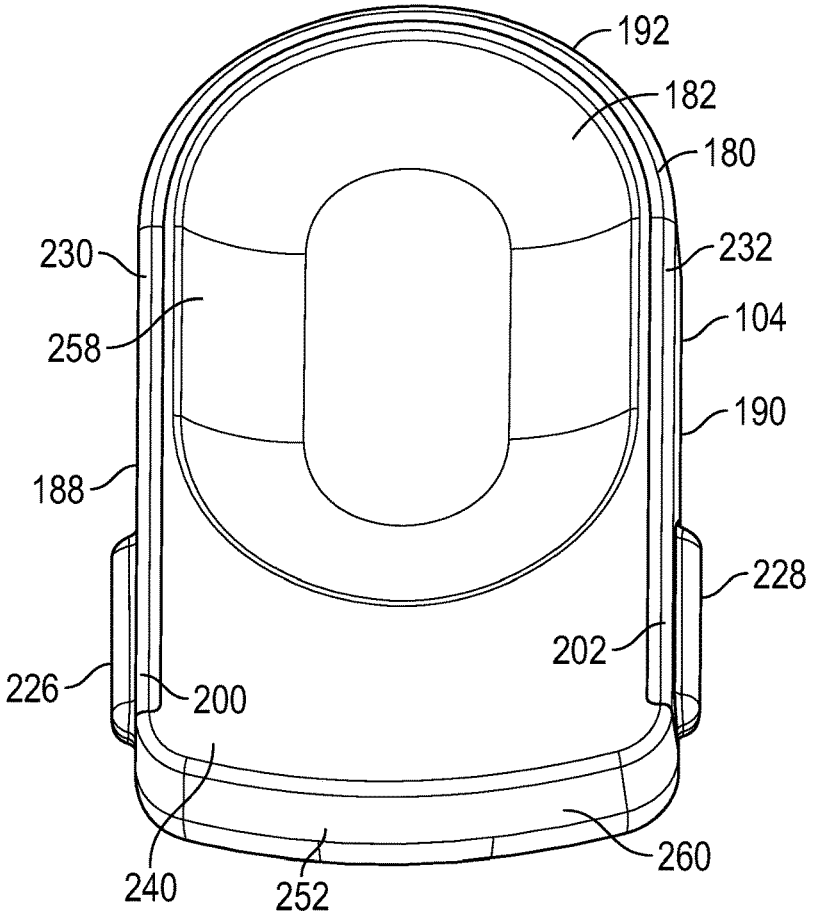
FIG. 5 is a top perspective view of the slider.

The insert 182 secured by the frame 180 includes the bottom surface 218, a top surface 240, opposite sides 244, 246, and opposite ends 250, 252. In FIGS. 5 and 6, the sides 188, 190 of the frame 180 are extended along the respective sides 244, 246, the end wall 192 of the frame 180 is extended along the end 250, and the base 194 of the frame 180 is extended along bottom side edge portions of the bottom surface 218. As such, an elongated central section of the bottom surface 218 of the insert 182 is not covered by the frame 180. The top surface 240 defines an exterior top surface of the slider 104, and can be formed with a finger depression 258. The end 252 together with the base 194 defines an end face 260 of the slider 104, and in the closed position of the slider the end face 260 is configured to sealingly engage the sidewall 110 of the lid 102 thereby preventing leakage or spillage through the drink opening 132.

With reference to FIG. 2, in the open position a length of the slider 104 is approximately equal to a length of the base section 146 of the recessed portion 130. With the second detents 226, 228 of the slider 104 received in the second guide track sections 166, 176 of the respective guide tracks 150, 152, the end wall 192 of the frame 180 abuts the inner end section 144 of the recessed portion 130 and the end face 260 of the slider 104 is adjacent an edge of the base section 146 that defines the drink opening 132. According to another aspect depicted in FIGS. 7 and 8, the opening travel of the slider 104 is limited such that in the open position a gap 264 is provided between the end wall 192 of the frame 180 and the inner end section 144 of the recessed portion 130, which, in turn, positions the end face 260 at least partially over the drink opening 132. Therefore, if residual fluid is trapped in the guide tracks 150, 152 and the slider 104 is pushed hard toward the open position, this location of the end face 260 of the slider 104 in the open position minimizes an upward splash of the residual liquid. To form this gap 264, a length of each second guide track sections 166, 176 is shortened to therefore define a hard stop for the slider 104, wherein the second detents 226, 228 are engaged between the first detents 156, 158 and inner surfaces of the second guide track sections 166, 176.

Figure 9:
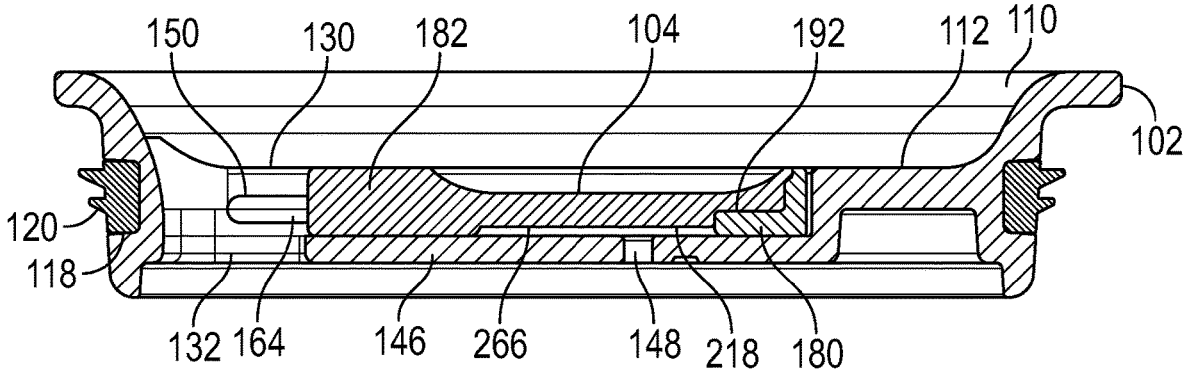
FIG. 9 is a cross-sectional view of the lid assembly of FIG. 2.
Figure 10:
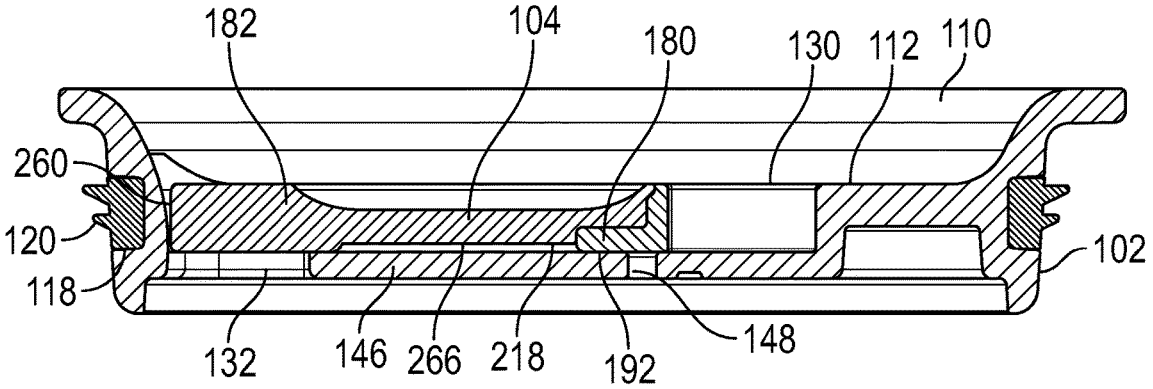
FIGS. 10 and 11 are cross-sectional views of the lid assembly of FIG. 1.
Figure 11:
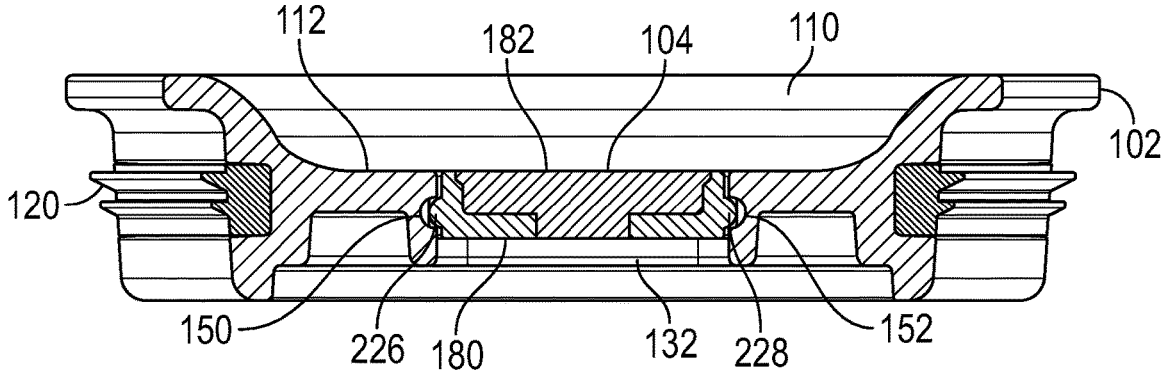

In FIG. 9, the slider 104 is in the open position exposing the drink opening 132. The base 194 of the frame 180 and the bottom surface 218 of the insert 182 are in direct contact with the base section 146 that defines the recessed portion 130 in the lid body top wall 112. The step-shaped bottom surface 218 of the insert 182 defines an undercut region 266 on the bottom surface 218, and in the open position of the slider 104, the undercut region 266 covers the vent opening 148 allowing the vent opening 148 to be open and communicate with atmosphere. In FIGS. 10 and 11, the slider 104 is in the closed position closing the drink opening 132. The end face 260 of the slider 104 is sealingly engaged the sidewall 110 of the lid 102, and the base 194 of the frame 180 directly closes the vent opening 148.

Figure 12:
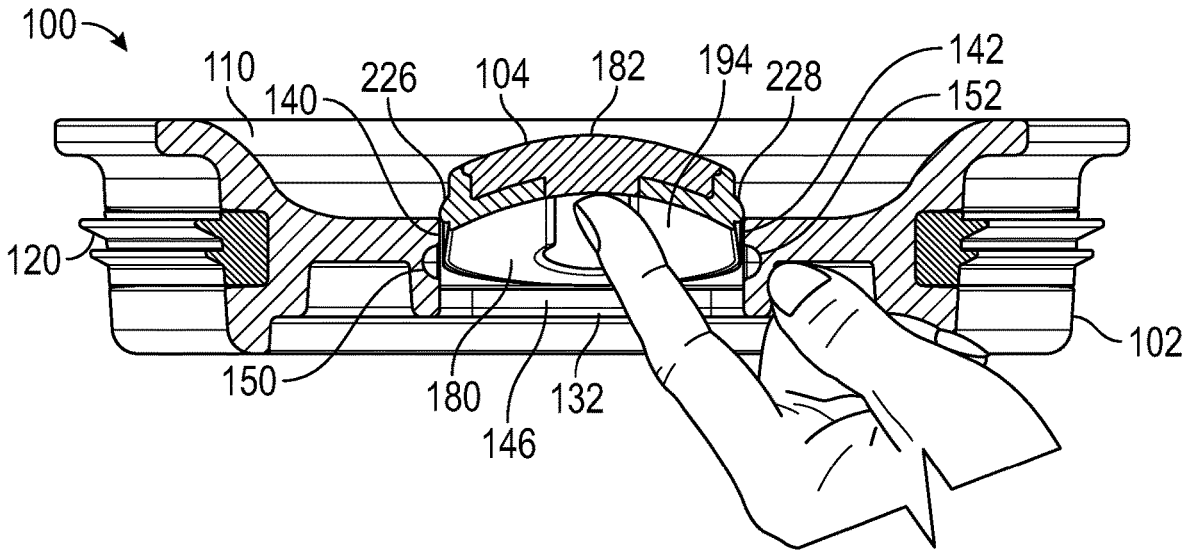
FIG. 12 is a top plan view of the lid assembly depicting the slider in an intermediate position between the closed position and the open position.

According to the present embodiment, the frame 180 is formed of a hard thermoplastic material and the insert 182 is formed of a softer, resilient and flexible material, e.g., a thermoplastic elastomer (TPE) material. This allows the insert 182 to be overmolded onto the frame 180 so as to be permanently and nonremovably attached to frame. Further, with the material of the insert 182, the slider 104 is configured to compress via the detent arrangement, which compression is required to move the slider 104 between the closed position and the open position. In FIG. 12 the slider 104 is in an intermediate position between the closed position and the open position, where the second detents 226, 228 of the slider 104 are engaged by the first detents 156, 158 in the guide tracks 150, 152. Because the shape of the frame 180 allows the frame sides 188, 190 to move inwardly toward one another, this engagement between the first and second detents inwardly moves the frame sides 188, 190, in turn, compressing the insert 182. With the insert compressed, the slider 104 is capable of moving past the first detents 156, 158 to one of the closed position and open position.

Figure 13:
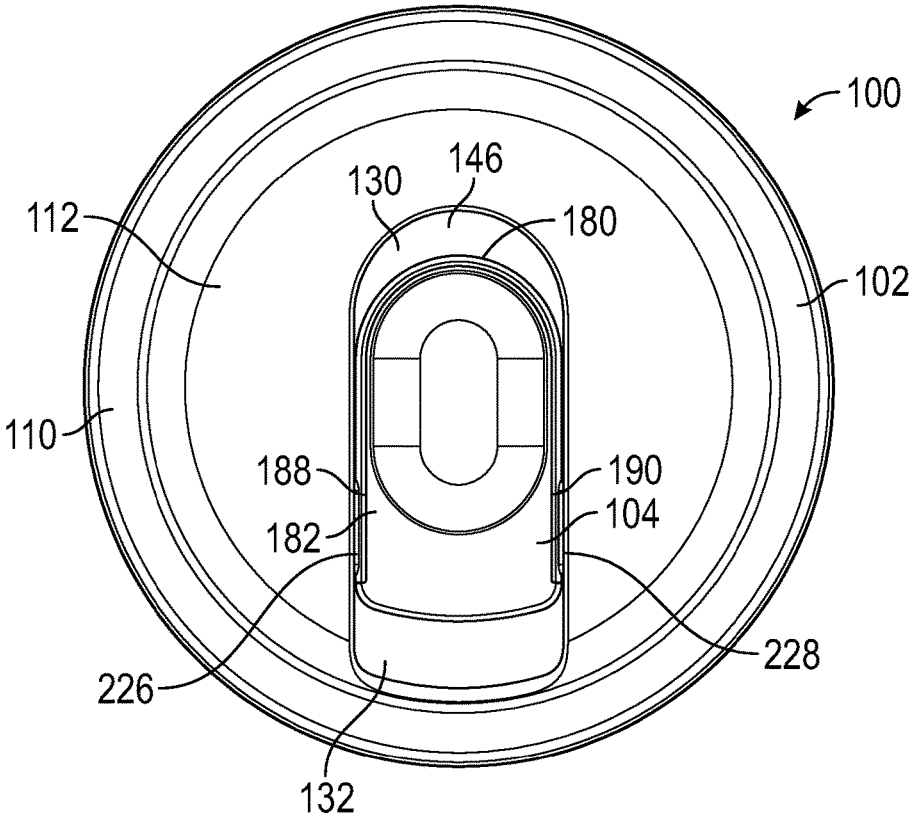
FIG. 13 is a cross-sectional view of the lid assembly of FIG. 1, depicting the slider being removed from the lid body.

Further, FIG. 13 depicts the slider 104 in the closed position being removed from the lid body 108. To remove the slider 104, the consumer presses the underside of the slider 104 in the closed position through the drink opening 132. The slider 104 is initially moved away from the base section 146 until the second detents 226, 228 engage upper edges of the guide tracks 150, 152. Continued pressing of the slider 104 causes the frame 180 and insert 182 to flex or bow outwardly, moving the second detents 226, 228 out of the guide tracks 150, 152, and allowing the second detents to slide against the inner sidewall sections 140, 142 out of the recessed portion 130. Therefore, with the shape of the frame 180 and the elastomeric insert 182, the slider 104 is configured to bow as the slider is being removed from the recessed portion. It should be appreciated that insertion of the slider 104 back into the recessed portion 130 can cause the slider to again flex and bow toward the base section 146 until the second detents 226, 226 are received in the guide tracks 150, 152.

Therefore, the present disclosure is directed to the closeable lid assembly 100 for a container (not shown), where the lid assembly 100 include the lid body 108 having the recessed portion 130 shaped to receive the slider 104. The drink opening 132, which spans approximately the entire width of the recessed portion 130, and the vent opening 148 are located in the recessed portion 130. The slider 104 is a two-part member including the hard thermoplastic frame 180 covering and the elastomeric insert 182 which is exposed from the top and includes the finger depression 258. The lid body 108 is static and the slider 104 is designed to flex in two directions. The slider 104 flexes inward about the frame 180 compressing the insert 182 to create a locking detent function as the slider 104 slides fore-aft in the lid body 108 between the closed and open positions to cover or expose the drink opening 132. With the frame shape and the elastomeric insert, the slider also flexes or bows relative the recessed portion 130 for easy removal and snap-in assembly. The slider 104 also covers the vent opening 148, although the undercut region 266 on the insert 182 provides a gap between the lid body 108 and the slider 104 allowing air to flow from the vent opening.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A lid assembly for an associated beverage container comprising:

a lid including a lid body having a sidewall for engaging an opening of the associated container and a top wall, the top wall includes an elongated recessed portion formed therein, the top wall has a drink opening located in the recessed portion adjacent the sidewall; and a slider removably received in the recessed portion, the slider is movable along a length direction of the recessed portion between a closed position for closing the drink opening and an open position for opening the drink opening, wherein the slider includes a frame and an elastomeric insert, the frame includes opposed sides and an elongated open-ended slot, the insert is secured within the open-ended slot of the frame with the sides of the frame extended along opposed sides of the insert, the insert defines an exterior top surface of the slider, wherein the lid and the slider have a cooperating detent arrangement configured to maintain the slider in the closed position or the open position, wherein the recessed portion is defined by inner sidewall sections and a base section of the top wall, each of the inner sidewall sections includes a guide track formed therein, a first detent of the detent arrangement is provided in each guide track, wherein each of the sides of the frame includes a second detent of the detent arrangement, the second detents sized for slidable receipt within the guide tracks, and wherein the sides of the frame are configured to move inwardly toward one another and compress the insert via engagement of the first and second detents of the detent arrangement as the slider is moved between the closed position and the open position.

2. The lid assembly of claim 1, wherein the frame is U-shaped in a top plan view, the frame includes a bottom extended along bottom side edge portions of the insert.

3. The lid assembly of claim 2, wherein the insert includes opposed ends, and in the closed position of the slider one of the ends is configured to sealingly engage the sidewall of the lid.

4. The lid assembly of claim 1, wherein each of the frame sides include a first end portion and an opposite second end portion, the second end portions are connected to one another, and the second detents are provided at the first end portions.

5. The lid assembly of claim 1, wherein the first detents separate the guide tracks into equally sized forward track sections and rear track sections, where in the closed position of the slider the second detents are received in the forward track sections, and in the open position of the slider the second detents are received in the rear track sections.

6. The lid assembly of claim 1, wherein the second detents are adapted to slide against the inner sidewall sections of the recessed portion as the slider is being removed from the recessed portion.

7. The lid assembly of claim 6, wherein the slider is configured to bow as the slider is being removed from the recessed portion.

8. The lid assembly of claim 1, wherein the insert is overmolded onto the frame so as to be permanently and nonremovably attached to frame.

9. The lid assembly of claim 1, wherein a vent opening is located in the recessed portion, the slider in the closed position closes the vent opening, and the slider includes an undercut region on a bottom surface allowing the vent opening to open in the open position of the slider.

10. A lid assembly for an associated beverage container comprising:

a lid including a lid body having a sidewall and a top wall, the top wall includes an elongated recessed portion formed therein, the top wall has a drink opening and a vent opening located in the recessed portion; and a slider removably received in the recessed portion, the slider is movable along a length direction of the recessed portion between a closed position where the drink opening and vent opening are closed and an open position where the drink opening and vent opening are open, wherein the slider includes a frame U-shaped in a top plan view and an elastomeric insert secured by the frame, the frame is extended along opposed sides and bottom side edge portions of the insert, wherein the lid and the slider have a cooperating detent arrangement configured to maintain the slider in the closed position or the open position, wherein the recessed portion is defined by inner sidewall sections and a base section of the top wall, each of the inner sidewall sections includes a guide track formed therein, a first detent of the detent arrangement is provided in each guide track, wherein each of opposed sides of the frame includes a second detent of the detent arrangement, the second detents sized for slidable receipt within the guide tracks, wherein the frame is configured to compress the insert as the slider is moved between the closed position and the open position via engagement of the first and second detents moving the sides of the frame inwardly toward one another.

11. The lid assembly of claim 10, wherein the guide tracks are sized such that in the open position of the slider a gap is formed between an end wall of the frame and an end section of the recessed portion and an end face of the slider is positioned at least partially over the drink opening.

12. The lid assembly of claim 10, wherein the frame is configured to allow for bowing of the insert as the slider is removed from the recessed portion.

13. The lid assembly of claim 10, wherein the insert includes an undercut region on a bottom surface allowing the vent opening to open in the open position of the slider.

14. The lid assembly of claim 10, wherein the insert is overmolded onto the frame so as to be permanently and nonremovably attached to frame.

* * * * *